US007062215B2

(12) United States Patent
Noda

(10) Patent No.: US 7,062,215 B2
(45) Date of Patent: Jun. 13, 2006

(54) IMAGE FORMING APPARATUS

(75) Inventor: Yasuo Noda, Fukushima (JP)

(73) Assignee: Oki Data Corporation, Tokyo (JP)

( * ) Notice: Subject to any disclaimer, the term of this patent is extended or adjusted under 35 U.S.C. 154(b) by 76 days.

(21) Appl. No.: 10/762,892

(22) Filed: Jan. 22, 2004

(65) Prior Publication Data

US 2004/0151525 A1 Aug. 5, 2004

(30) Foreign Application Priority Data

Jan. 24, 2003 (JP) ..... 2003-015638

(51) Int. Cl.
*G03G 15/00* (2006.01)

(52) U.S. Cl. ..... 399/389; 399/376

(58) Field of Classification Search ..... 399/388–389, 399/376

See application file for complete search history.

(56) References Cited

U.S. PATENT DOCUMENTS 5,464,204 A * 11/1995 Suzuki ..... 271/110
5,722,029 A * 2/1998 Tomidokoro et al. ..... 399/389
6,674,981 B1 * 1/2004 Sugimoto ..... 399/81

FOREIGN PATENT DOCUMENTS

JP 05-116811 A 5/1993
JP 07277550 A * 10/1995
JP 10016345 A * 1/1998

* cited by examiner

*Primary Examiner*—Minh Chau
(74) *Attorney, Agent, or Firm*—Akin Gump Strauss Hauer & Feld, LLP

(57) ABSTRACT

An image forming apparatus includes a medium width detector and a controller that controls the medium width detector. The medium width detector detects a width of a page of print medium. The controller selects one of a plurality of medium cassettes and controls the medium width detector accordingly. When a predetermined condition is detected, the controller controls the medium width detector to detect the width of the page of print medium. The predetermined conditions include, for example, (1) when a printing operation is performed for the first time after power up of the apparatus; (2) when print data has not been received for a predetermined time length after a last reception of print data; (3) printing is performed for the first time after failure of transport of print medium occurs, a medium feeding mode is switched, and (4) when a print job is received.

18 Claims, 12 Drawing Sheets

IMAGE FORMING APPARATUS

BACKGROUND OF THE INVENTION

1. Field of the Invention

The present invention relates to an image forming apparatus.

2. Description of the Related Art

Conventional image forming apparatus such as a dot printer is provided with a paper width sensor. Prior to printing on print paper, a print head is caused to run in a direction substantially perpendicular to a direction of travel of the print paper, thereby detecting the width of the print paper. Then, based on the detected width of the print paper, control is performed to identify the location on the print paper on which printing should be made, thereby preventing fault printing outside of the print paper area as well as transporting the print paper to an appropriate position.

With such an image forming apparatus, the detection of paper width is performed for each page of print paper fed from a paper cassette.

However, detecting the paper width of each page prior to printing requires a longer time for printing each page, resulting in a decreased throughout of the image forming apparatus.

With the conventional apparatus, the width of print paper is detected even when the print paper is fed from the paper cassette. Because all pages of the print paper held in the same paper cassette have the same width, when a plurality of pages are to be printed, it is only necessary to detect the width of the first page.

SUMMARY OF THE INVENTION

An object of the present invention is to provided an image forming apparatus in which when pages of print paper are fed from a paper cassette, the number of times the width of print paper is detected is maintained minimum to improve the throughput of the image forming apparatus.

An image forming apparatus includes a medium-width detector and a controller. The medium-width detector detects a width of a page of print medium. The controller controls the medium-width detector to detect the width of the page of print medium upon detection of a predetermined condition.

If a printing operation is performed for a first time after power up of the image forming apparatus, the controller controls the medium-width detector to detect the width of the page of print medium.

When print data has not been received for a predetermined time length after a last reception of print data, the controller controls the medium-width detector to detect the width of the page of print medium.

When a printing operation is performed for a first time after failure of transport of the print medium occurs, the controller controls the medium-width detector to detect the width of the page of print medium.

The failure of transport of the print medium is caused by absence of print medium.

The failure of transport of the print medium is caused by abnormal transport of print medium.

When a medium feeding mode is switched from one mode to another, the controller controls the medium-width detector to detect the width of the page of print medium.

When a print job is received, the controller controls the medium-width detector to detect the width of a first page of print medium in the print job.

When printing is performed on a following page of two consecutive pages of print medium, the controller controls the medium-width detector to detect the width of the following page if the following page has a size different from a preceding page of the two consecutive pages of print medium.

When printing is performed on a following page of two consecutive pages of print medium, the controller controls the medium width detector to detect the width of the following page if the print is performed on the following page in a direction different from a preceding page of the two consecutive pages of print medium.

An image forming apparatus includes a medium-width detection and a controller. The medium-width detector that detects a width of a page of print medium. The controller controls the medium width detector to detect the width of a first page of print medium supplied from the second cassette when the controller switches from a first cassette to a second cassette.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Construction}

Embodiments of the invention will be described in detail with reference to the accompanying drawings.

Figure 1:
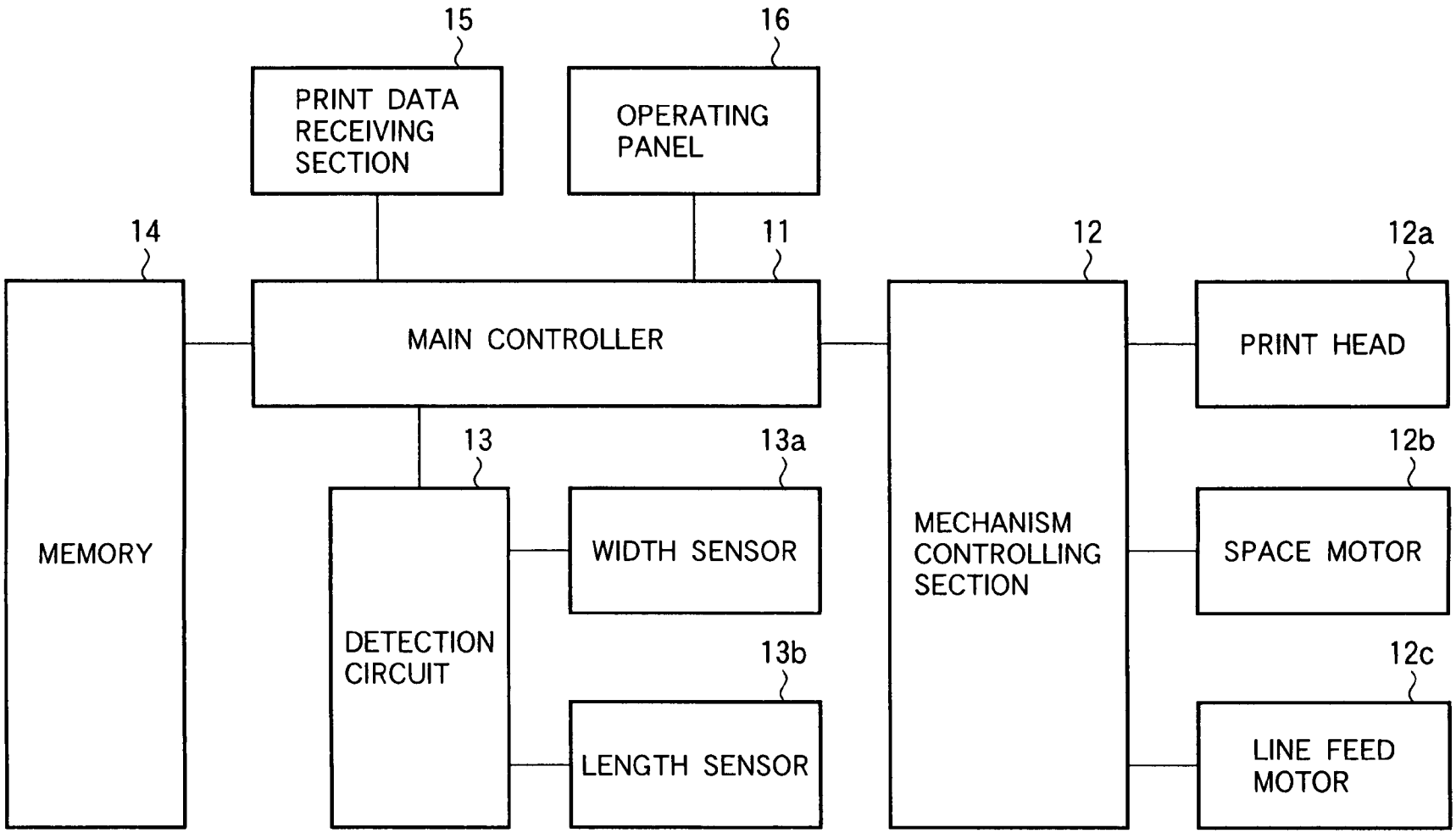
FIG. 1 is a block diagram illustrating the configuration of an image forming according to a first embodiment of the invention.

FIG. 1 is a block diagram illustrating the configuration of an image forming apparatus according to a first embodiment of the invention.

Referring to FIG. 1, an image forming apparatus is constructed of a main controller 11, a mechanism controlling section 12, and a detection circuit 13, a memory 14, a print data receiving section 15, and an operating panel 16.

The image forming apparatus according to the present invention takes the form of, for example, a dot impact printer that prints a dot image on print paper as a print medium. The image forming apparatus has two paper-width detection modes: a power-up-only mode in which detection of the width of print paper is performed only for the first page of the print paper after power up of the apparatus and an every-page mode in which detection of the width of print paper is performed for every page of the print paper. The image forming apparatus has a mode setting means that selectively sets either the power-up-only mode or the every-page mode.

The main controller 11 receives control data, print data, and control signals from a host apparatus, not shown, through the data receiving section 15. Then, the controller 11 analyzes the control data, produces data, and control signals and produces bit map data from the print data. The bit map data is stored into an image buffer. The data receiving section 15 receives various items of data from the host apparatus. The control signals are communicated between the data receiving section 15 and the host apparatus.

When the image forming apparatus according to the invention is a dot printer, the mechanism controlling section 12 has a plurality of dot-pins, a print head 12*a*, a space motor 12*b*, and a line feed motor 12*c*. The dot-pins print a dot pattern produced by the main controller 11. The space motor 12*b* drives the print head 12*a* to move in a direction substantially perpendicular to the direction of travel of the print paper. The line feed motor 12*c* performs line feeding of the print paper.

The detection circuit 13 receives detection signals from a width sensor 13*a* and a length sensor 13*b*. The width sensor 13*a* detects the paper width while the length sensor 13*b* detects the leading end and trailing end of the print paper. The width sensor 13*a* is mounted on the print head 12*a*.

The memory 14 has a buffer memory that stores the print data supplied from the main controller 11 before the print data is converted into bit map data in an image buffer. The memory 14 also includes a memory area that stores data such as the width and length of print paper detected by the detection circuit 13. The memory 14 further includes a non-volatile memory that stores a set-up mode selected through the operating panel 16.

The operating panel 16 has operation keys, not shown, for selecting operation modes including an operation mode in which the paper width is detected, and a display panel for displaying the operation status of the apparatus.

The firmware of the image forming apparatus will be described.

Figure 2:
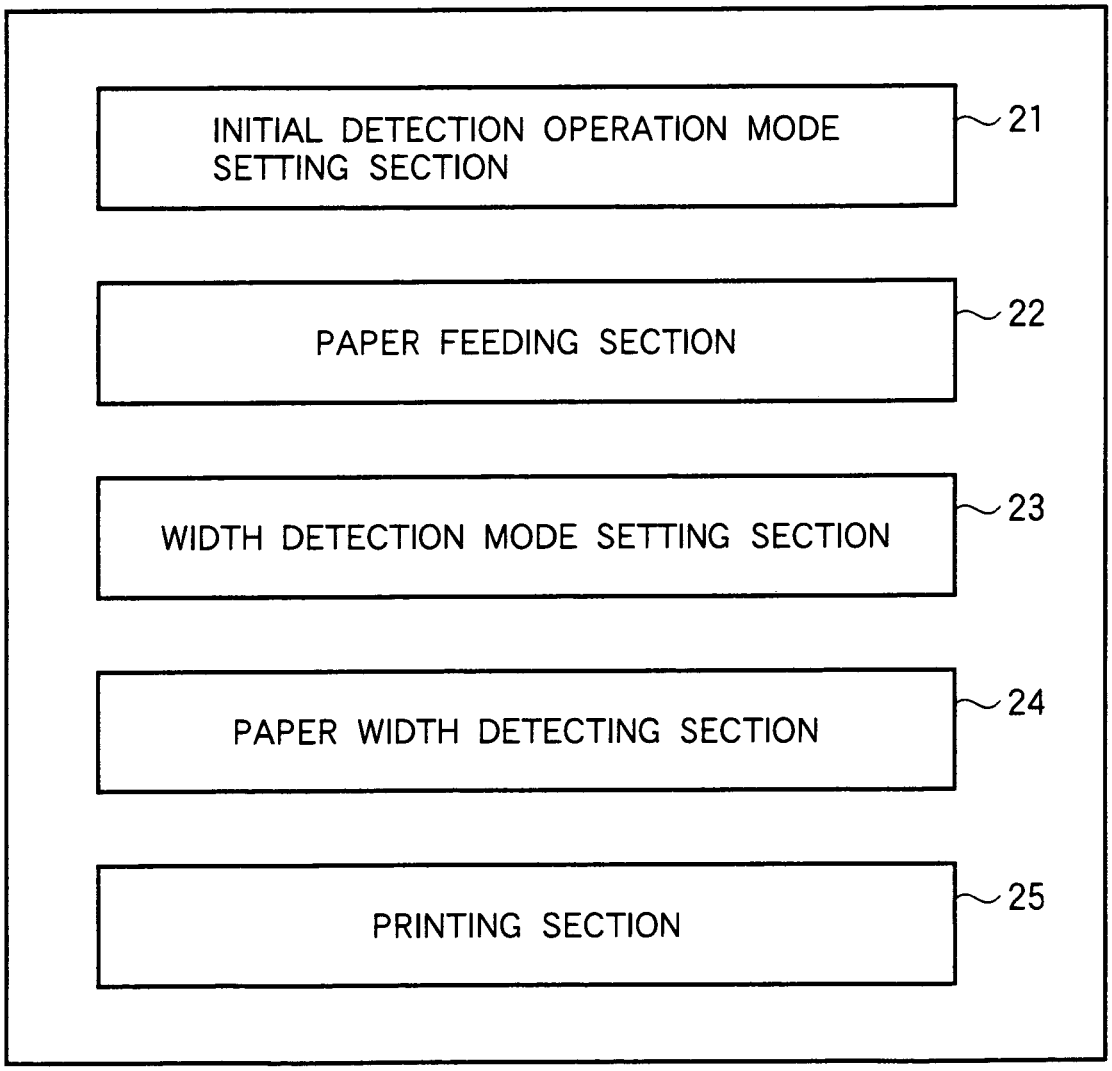
FIG. 2 is a block diagram illustrating the firmware of the image forming apparatus according to the first embodiment.

FIG. 2 is a block diagram illustrating the firmware of the image forming apparatus according to the first embodiment.

The firmware includes an initial-detection-mode setting section 21, a paper feeding section 22, a width detection mode setting section 23, a paper-width detecting section 24, and a printing section 25. The main controller 11 activates the width detecting section 24 only in a particular case as described later.

The initial-detection-mode setting section 21 sets a detection mode, which is an initial set-up performed immediately after the image forming apparatus is turned on. When the paper-feeding section 22 receives a paper feeding command from a host apparatus, not shown, the paper-feeding section 22 performs a paper-feeding operation. In accordance with the status of the paper width detecting section 24 and the initial-detection-mode setting section 21, the width detection mode setting 23 determines whether a paper-width detecting operation should be performed. The width detecting section 24 drives the print head 12*a* to run in the direction of width of the print paper, thereby detecting the width of the print paper based on the detection signal output from the width sensor 13*a* mounted on the print head 12*a*. The printing section 25 processes the print data for one page of print paper received from the host apparatus.

{Operation}

The operation of the image forming apparatus of the aforementioned configuration will be described.

Set-Up Mode

Figure 3:
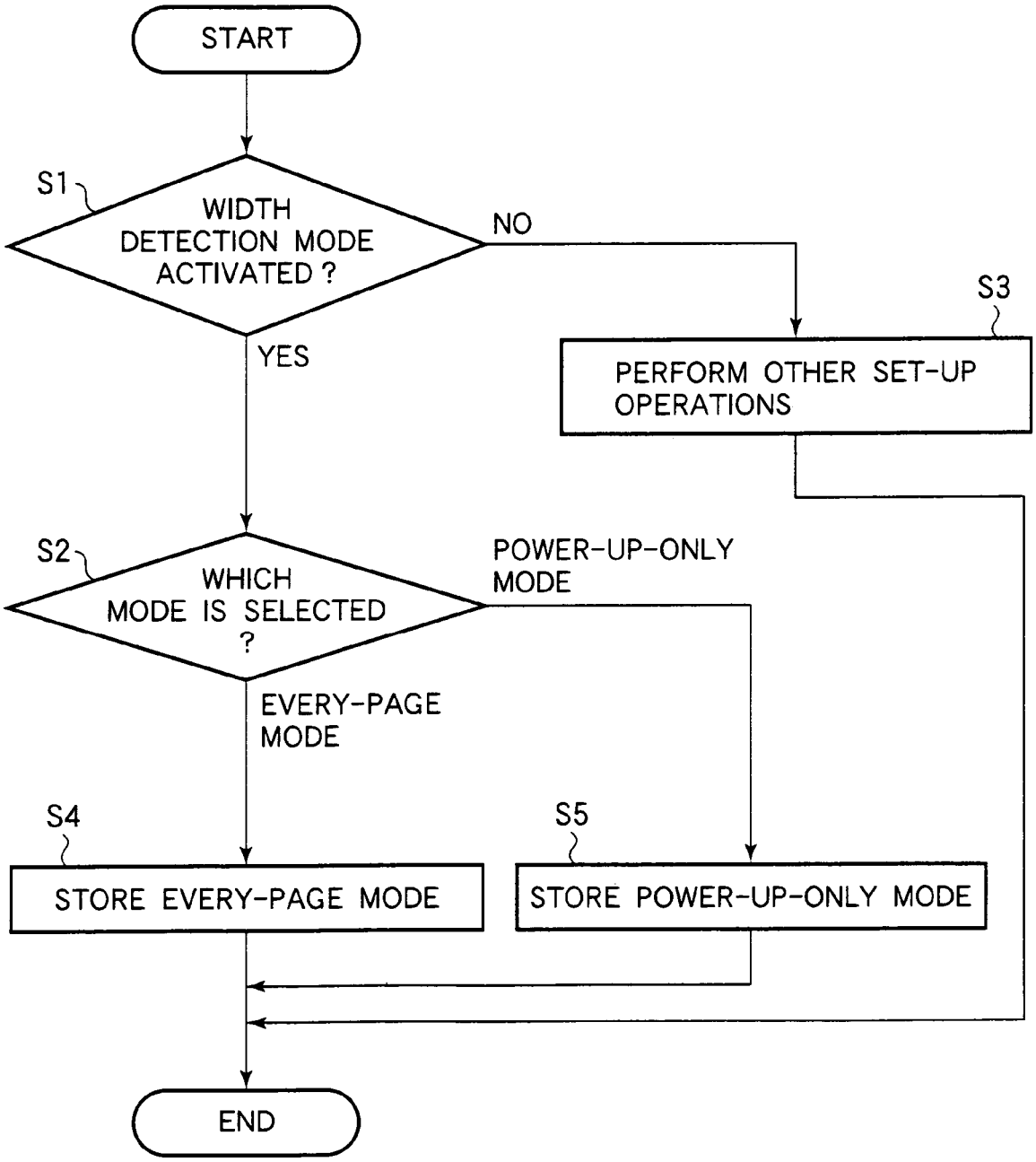
FIG. 3 is a flowchart illustrating the operation for setting a paper width detecting mode.

FIG. 3 is a flowchart illustrating the operation for setting the paper-width detection mode.

A set-up operation for specifying the paper-width detection mode will be described.

When the user attempts to activate a set-up mode by operating an operation key on the operation section 16, a check is made to determine whether the paper-width detection mode has been activated (S1). If the paper-width detection mode has not been activated yet, then set-up operations in other set-up modes than the paper-width detection mode are performed for set-up operations (S3).

If it is determined that the paper-width detection mode has been activated, then selection is made to specify the proper paper-width detection mode, in other words, selection is made to specify either the every-page mode or the power-up-only mode (S2). Whichever mode is selected, the selected mode is stored into the non-volatile memory in the memory 14 (S4, S5).

The flowchart in FIG. 3 will be described.

Step S1: A check is made to determine whether the paper-detection mode has been set. If YES, the program proceeds to step S2, and if NO, the program proceeds to step S3.

Step S2: A check is made to determine which mode has been selected. If the every-page mode is selected, the program proceeds to step S4, and if the power-up-only mode is selected, the program proceeds to step S5.

Step S3: Set-up operations in other set-up modes than the paper-width detection mode are performed.

Step S4: The paper-width detection is set the power-up-only mode, which in turn is stored into the non-volatile memory.

Step S5: The paper-width detection is set to the every-page mode, which in turn is stored into the non-volatile memory.

Paper-Width Detection and Printing

Figure 4:
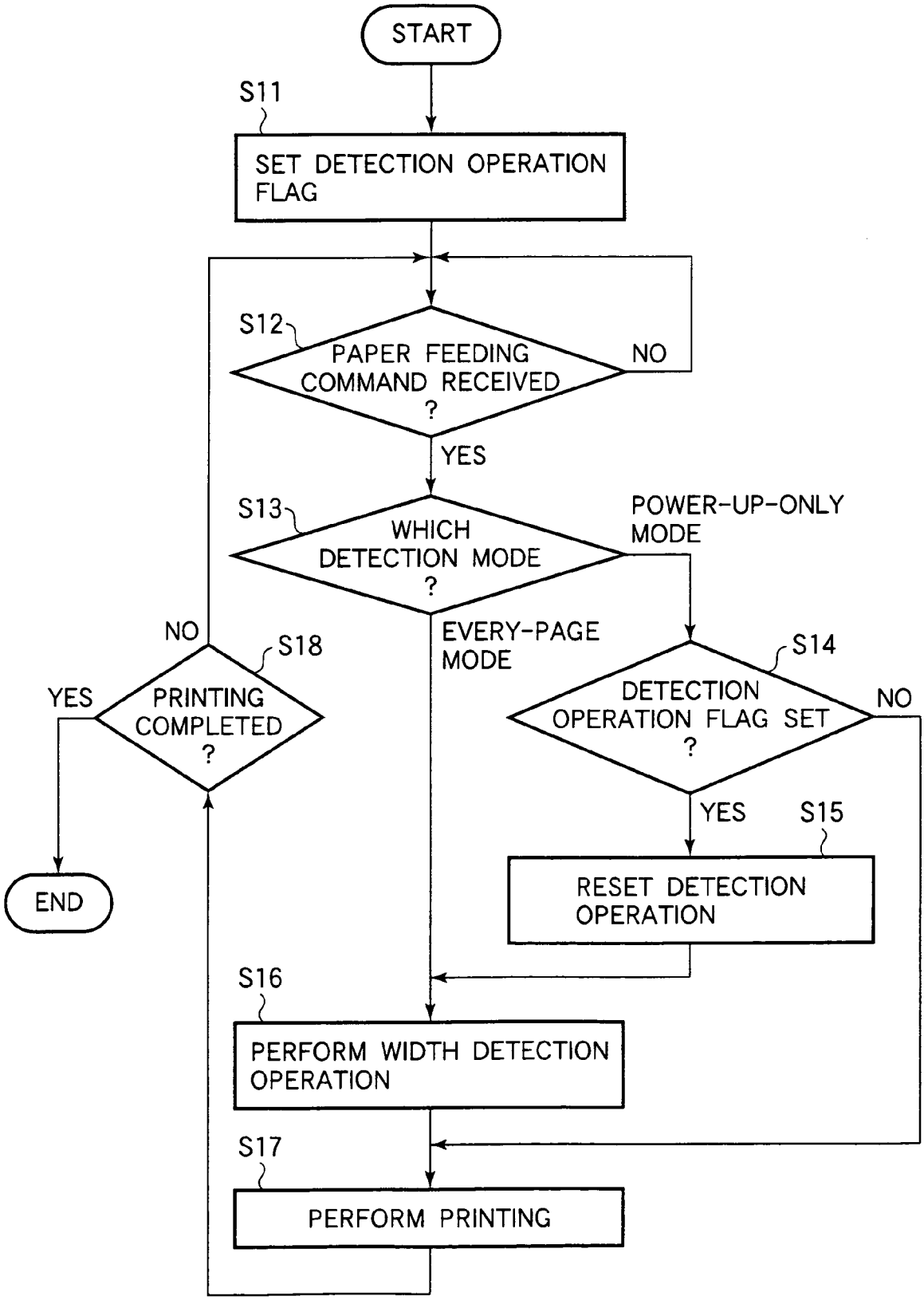
FIG. 4 is a flowchart illustrating the operation in which paper width is detected and before printing is performed.

FIG. 4 is a flowchart illustrating the operation in which paper width is detected and printing is performed.

The paper-width detecting and printing operations will be described.

Upon power-up of the image forming apparatus, a detection operation flag is set as an initial setting (S11). Then, upon receiving the paper feeding command from the host apparatus, the paper feeding operation is initiated (S12). When the paper feeding operation is completed, the paper-width detection mode is read from the non-volatile memory of the memory 14, thereby activating either the every-page mode or the power-up-only mode (S13).

In the every-page mode, the paper-width detecting section 24 drives the print head 12*a* to run in the direction of width of the print paper, enabling the width sensor 13*a* to detect the width of the print paper (S16).

In the power-up-only mode, a check is made to determine whether the detection operation flag has been set (S14). If the detection operation flag has been set (Y at step S14), the detection operation flag is reset and the paper-width detection is performed (S15) and subsequently the paper-width detection is performed (S16). Then, the print data for one page received from the host apparatus is processed and printing is performed (S17). Then, the next page is fed (S12).

If the detection operation flag has been reset (N at step S14), the paper-width detection is not performed and printing begins immediately (S17). Because the power-up-only mode was activated to determine whether printing is performed for the first time after the image forming apparatus is turned on, once the detection operation flag has been reset (S15), the paper-width detection will not be performed for subsequent pages of print paper.

The operation of paper-width detection and printing will be described.

Step S11: The detection operation flag is set.

Step S12: A check is made to determine whether the paper feeding command has been received. If YES, the program proceeds to step S13, and if NO, the program enters a standby state where the paper feeding operation is not performed.

Step S13: A check is made to determine whether the paper-detection mode is in the every-page mode or in the power-up-only mode. If the every-page mode has been set, then the program proceeds to step S16, and if the power-up-only mode has been set, then the program proceeds to step S14.

Step S14: A check is made to determine whether the detection operation flag has been set. If YES, the program proceeds to step S15. If NO, the program proceeds to step S17.

Step S15: The detection operation flag is set.

Step S16: The paper-width detection is performed.

Step S17: Printing is performed.

Step S18: A check is made to determine whether printing has been completed. If YES, the program ends. If NO, the program loops back to Step S12.

The invention minimizes the number of times the width of the print paper fed from the paper cassette is detected, thereby preventing the throughput of the image forming apparatus from decreasing.

The present invention utilizes the fact that the size of print paper is not changed very often after the apparatus is turned on. Thus, when the power-up-only mode is specified, the detection of the print paper is performed only once.

When the paper size of the second page onward is different from the first page, or the width of the print paper should be detected very accurately, the paper-width detection may be readily switched to the every-page mode in which paper-width detection is performed for every page of print paper.

{Modification}

While the first embodiment has been described with respect to a dot printer, the invention is also applicable to an electrophotographic apparatus such as an electrophotographic printer and an electrophotographic copying machine.

Figure 5:
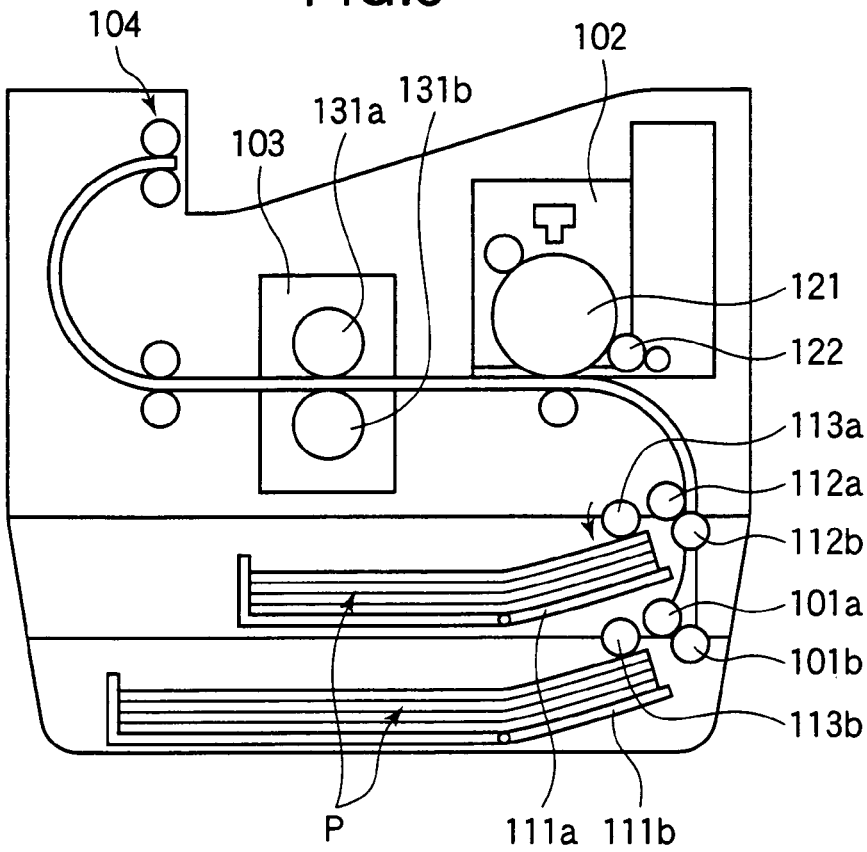
FIG. 5 illustrates a modification to the embodiment.

FIG. 5 illustrates a modification to the embodiment.

A modification to the first embodiment will briefly be described with reference to FIG. 5. A stack of print paper P is held in a paper cassette of a paper feeding mechanism. The print paper P is fed by feeding rollers 112*a*–112*b* or 101*a*–101*b* to an image forming section 102. An electrostatic latent image is formed on a photoconductive drum 121. A developing roller 122 supplies toner, not shown, to the electrostatic latent image to form a toner image. Then, a transfer roller transfers the toner image onto a print paper. The print paper P is then transported to a fixing unit 103 where the print paper is pulled in between a pair of fixing rollers 131*a* 131*b* so that the toner image is fused under pressure and by heat into a permanent image. The print paper P is then discharged through a discharge port 104 from the image forming apparatus.

Figure 6:
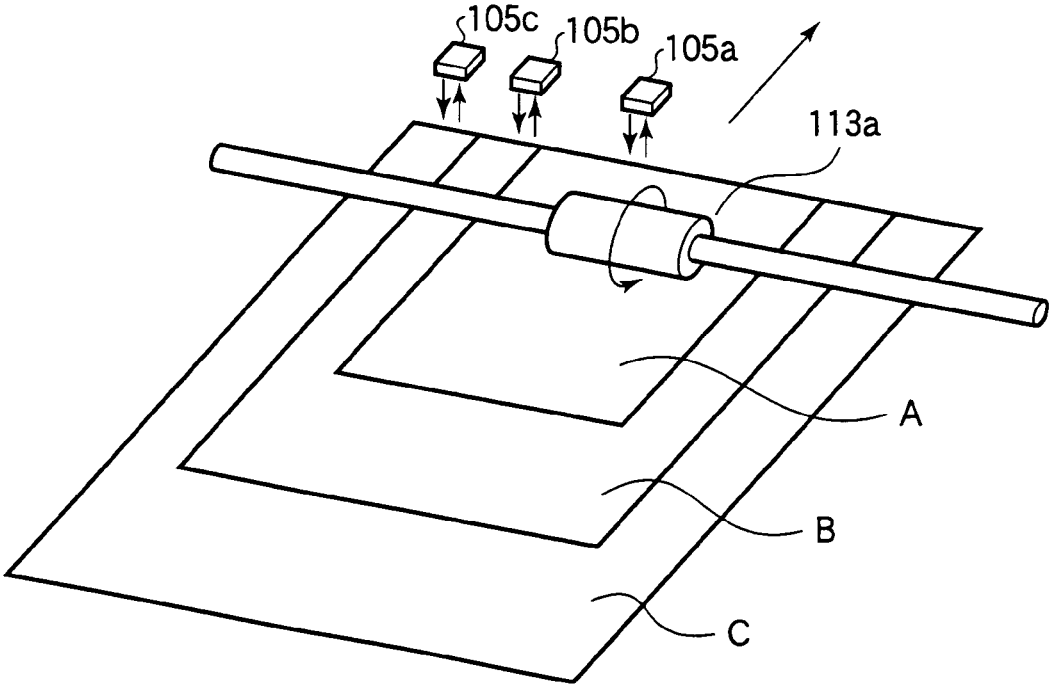
FIG. 6 illustrates a paper feeding mechanism according to the modification.

FIG. 6 illustrates a paper feeding mechanism according to the modification.

A paper feeding operation will be described with reference to FIG. 6. The print paper P in the paper cassette 111*a* or 111*b* is advanced by a hopping roller 113*a* or 113*b* to the feeding rollers 112*a* and 112*b*. Reflective sensors 105*a*, 105*b*, and 105*c* as a medium-width detector are spaced apart by predetermined distances in a direction transverse to a direction of travel of the print paper P. The respective sensors 105*a*, 105*b*, and 105*c* detect light reflected back by print paper P of corresponding sizes A, B, and C, respectively, thereby detecting the size of the print paper P.

The number of sensors 105*a*, 105*b*, and 105*c* and the positions of the sensors 105*a*, 105*b*, and 105*c* can be selected as desired. If the image forming apparatus incorporates a plurality of paper cassettes, a controller selects a paper cassette from the plurality of paper cassettes and printing is performed on the print paper P supplied from the selected paper cassette. When the controller switches from one paper cassette to another paper cassette, the controller controls the sensors 105*a*, 105*b*, and 105*c* to detect the width of a first page of print paper P supplied from the selected paper cassette.

Figure 7:
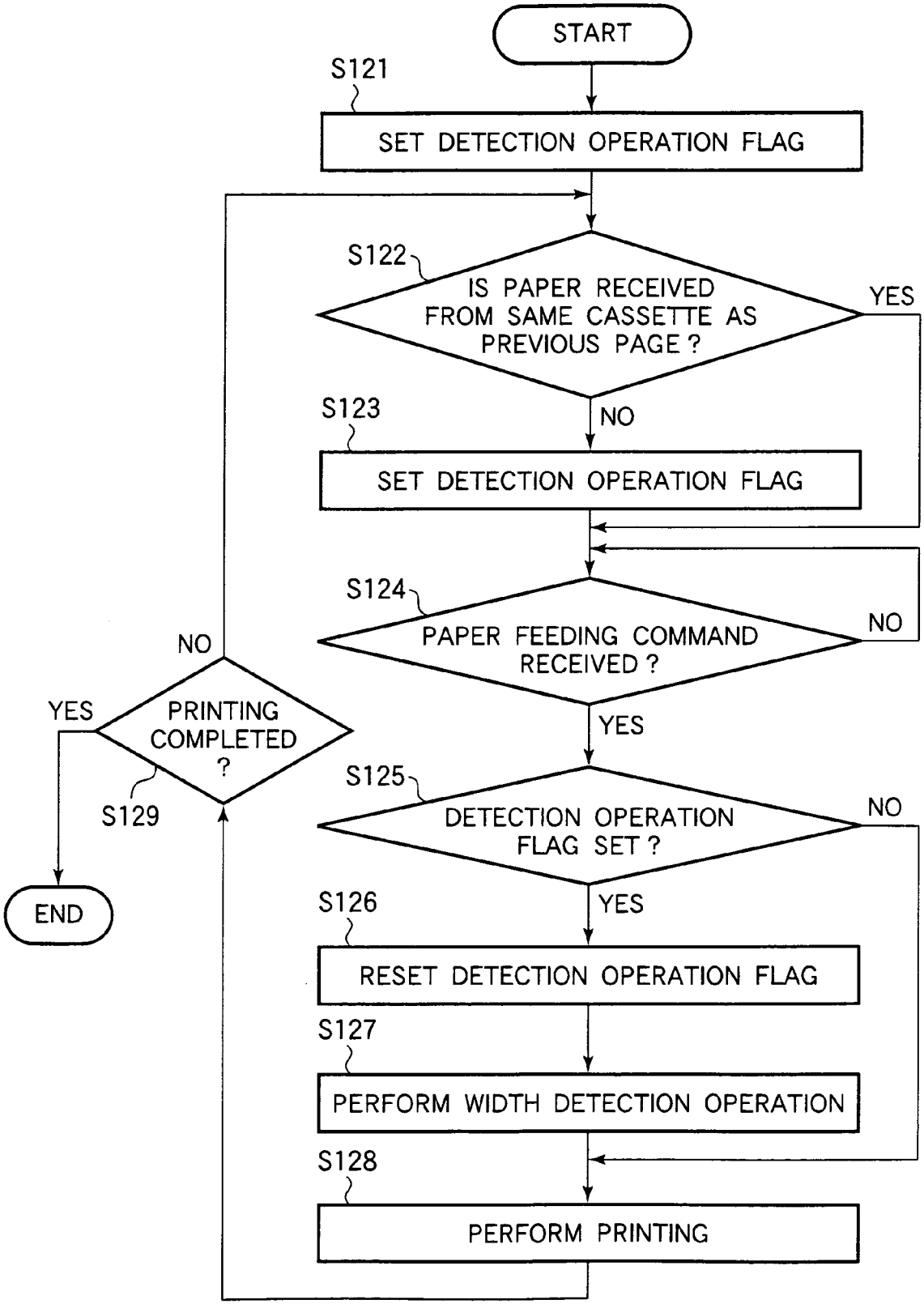
FIG. 7 is a flowchart illustrating paper-width detecting and printing operations.

FIG. 7 is a flowchart illustrating paper-width detecting and printing operations.

The paper width detecting and printing operations will be described with reference to FIG. 7.

When the image forming apparatus is turned on, the detection operation flag is first set (S121). Then, a check is made to determine whether the controller has switched from one paper cassette to another paper cassette (S122). If the controller has switched from one paper cassette to another paper cassette (S122), then the detection operation flag is set (S123) and subsequently the paper feeding operation begins (S124) upon a paper feeding command from the host apparatus. If the controller has not switched from one paper cassette to another paper cassette (S122), the program waits for a paper feeding command from the host apparatus (S124).

After the paper feeding operation begins (S124), a check is made to determine whether the detection operation flag has been set (S125). If the detection operation flag has been set (S125), the detection operation flag is reset (S126) and the paper-width detection operation is performed (S127) before performing a printing operation (S128). If the detection operation flag has not been set (S125), a printing operation begins immediately (S128). Subsequently, print data for one page is received from the host apparatus and processed for printing data. Then, the next page of print paper is fed.

The paper-width detecting and printing operations will be described with reference to the flowchart.

Step S121: The detection operation flag is set.

Step S122: A check is made to determine whether the controller has switched from one paper cassette to another paper cassette. If the controller has switched from one paper cassette to another paper cassette, then program proceeds to step S123. If the controller has not switched from one paper cassette to another paper cassette, the program proceeds to step S124.

Step S123: The detection operation flag is set.

Step S124: A check is made to determine whether a paper feeding command is received. If the paper feeding command has been received, the program proceeds to step S126, if the paper feeding command has not been received, the program enters a standby state.

Step S125: A check is made to determine whether the detection operation flag has been set. If YES, the program proceeds to step S126, and if NO, the program proceeds to step S128.

Step S126: The detection operation flag is reset.

Step S127: The paper-width detection is performed.

Step S128: Printing is performed.

Step S129: A check is made to determine whether printing has been completed. If YES, the program ends. If NO, the program loops back to Step S122.

Second Embodiment

A second embodiment will be described with reference to FIGS. 8 and 9.

Figure 8:
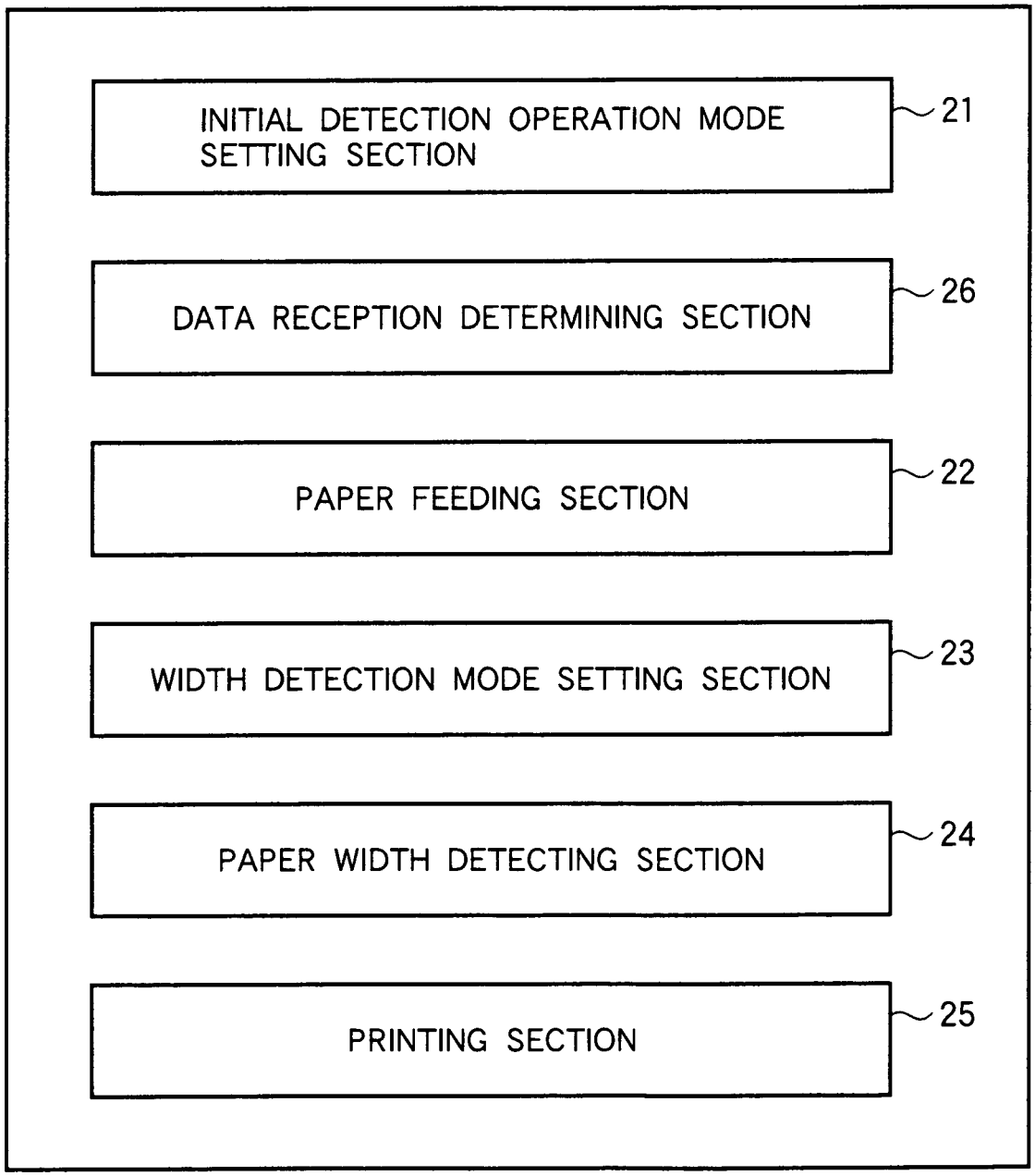
FIG. 8 is a block diagram illustrating a firmware of an image forming apparatus according to a second embodiment.

FIG. 8 is a block diagram illustrating a firmware of an image forming apparatus according to the second embodiment.

The second embodiment is featured in that when a printing operation is to be performed a certain length of time after print data is no longer supplied from a host apparatus, detection of the width of print paper is performed.

The second embodiment differs from the first embodiment in that a data-reception determining section 26 is provided as shown in FIG. 8. The data-reception determining section 26 resets a timer at a timing when the data-receiving section 15 receives data from a host apparatus, not shown. Then, the timer begins to count up. If the data receiving section 15 does not receive print data for a predetermined length of time, the timer continues to count up. The data-reception determining section 26 monitors the timer count to determine whether the timer count exceeds a predetermined time length by, for example, 2 seconds. When the timer count exceeds the predetermined time length by 2 seconds, the detection operation flag is set.

Figure 9:
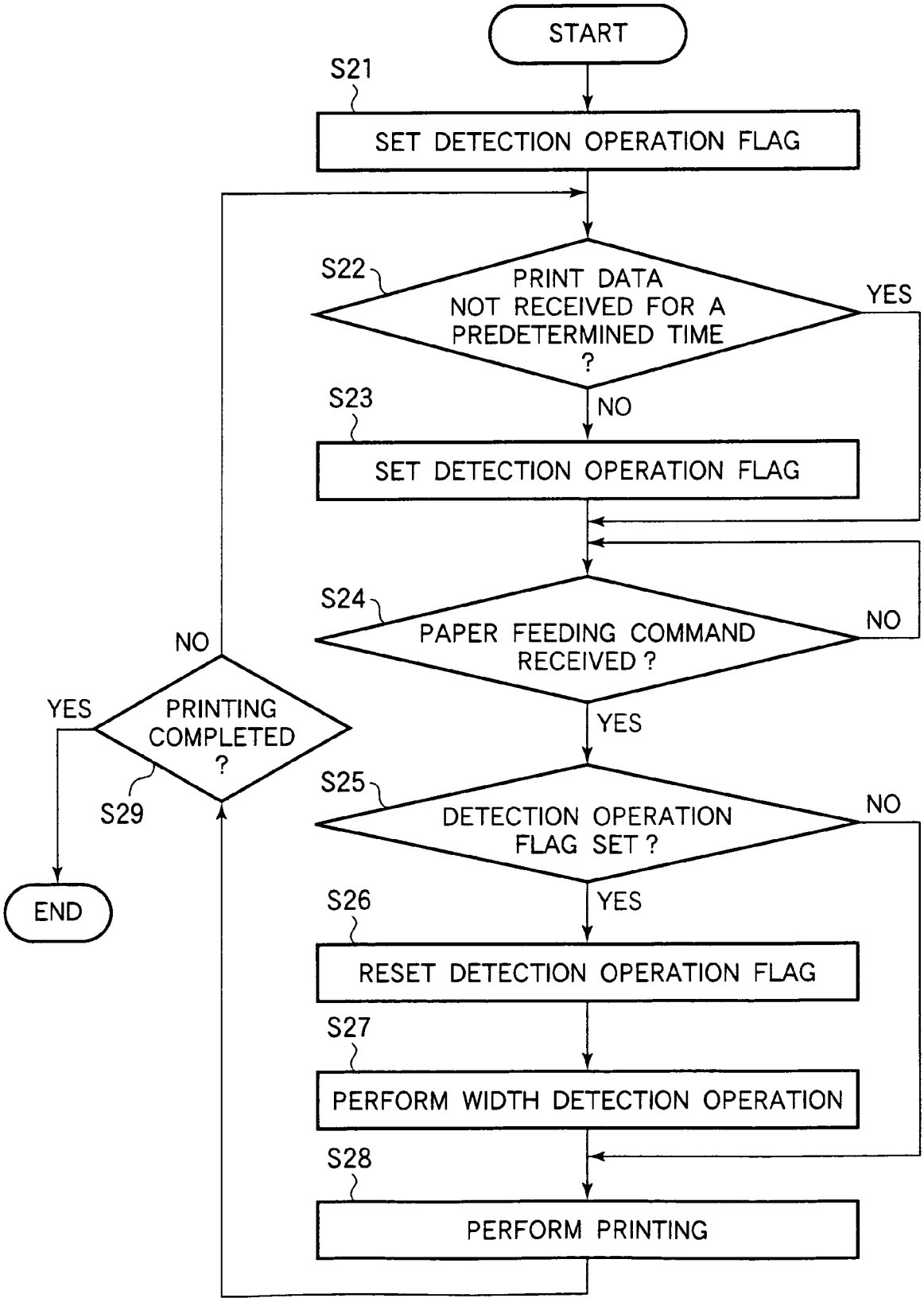
FIG. 9 is a flowchart illustrating the paper-width detecting and printing operations.

FIG. 9 is a flowchart illustrating paper-width detecting and printing operations.

The paper width detecting and printing operations will be described.

When the image forming apparatus is turned on, the detection operation flag is first set (S21). Then, the data reception determining section 26 resets the timer count upon reception of print data for each page, and thereafter the timer counts up. The data reception determining section 26 monitors the timer count to determine whether the timer count exceeds a predetermined time length by, for example, 2 seconds before any print data is received. When the timer count exceeds the predetermined time length by 2 seconds, the detection operation flag is set (S23).

In the second embodiment, an elapsed time length between data receptions from the host apparatus is monitored. If no print data is received for a predetermined time length (S22), the detection operation flag is set (S23). In other words, when print data for a plurality of pages is being received in sequence, the detection operation flag is not set and therefore, the paper-width detection is not performed. If the data reception is interrupted for a time length longer than a predetermined value, then the paper-width detection is performed for the first page of print paper fed after the interruption. Alternatively, the paper-width detection may also be performed on a job-to-job basis. In other words, the paper-width detection may be performed for the first page in each printing job.

Subsequently, a paper feeding operation begins upon the paper feeding command from the host apparatus (S24). After the paper feeding operation, a check is made to determine whether the detection operation flag has been set (S25). If the detection operation flag has been set, the detection operation flag is reset (S26) and then the paper-width detection is performed (S27). Subsequently, print data for one page received from the host apparatus is processed and printed (S28). Then, the next page of print paper is fed.

The paper-width detecting and printing operations will be described with reference to the flowchart.

Step S21: The detection operation flag is set.

Step S22: A check is made to determine whether the data receiving section 15 has not received print data for a predetermined time length. If the data has not been received, the program proceeds to step S23. If the data has been received, the program proceeds to step S24.

Step S23: The detection operation flag is set.

Step S24: A check is made to determine whether the paper feeding command has been received. If the paper feeding command has been received, the program proceeds to step S25, if the paper feeding command has not been received, the program enters a standby state.

Step S25: A check is made to determine whether the detection operation flag has been set. If YES, the program proceeds to step S26, and if NO, the program proceeds to step S28.

Step S26: The detection operation flag is reset.

Step S27: The paper-width detection is performed.

Step S28: Printing is performed.

Step S29: A check is made to determine whether printing has been completed. If YES, the program ends. If NO, the program loops back to Step S22.

The second embodiment addresses a problem encountered when the user loads a stack of print paper in the paper cassette with the apparatus remaining turned on. When the receipt of the print data from the host apparatus is interrupted, the paper-width detection is performed for the first page of print paper fed after the interruption. This paper-width detection prevents the print data supplied after the interruption from being printed on print paper of the wrong size. Also, when a plurality of pages of print paper are being printed without interruption, the paper-width detection operation is not performed so that the overall throughput of the image forming apparatus is prevented from decreasing.

The second embodiment allows paper-width detection to be performed at an appropriate timing without providing an additional sensor for detecting that print paper is replenished into the paper cassette. Thus, the second embodiment prevents the overall cost of the image forming apparatus from increasing.

An apparatus according to the second embodiment may include the power-up-only mode described in the first embodiment. Alternatively, the main controller 11 may store into a memory the paper-width information on the final page of print paper that was used in the printing operation performed immediately before the apparatus is turned off. Then, when the apparatus is turned on again, the main controller 11 may read the information from the memory and set the paper width.

Third Embodiment

Elements similar to those in the first and second embodiments have been given the same reference numerals and the description thereof is omitted.

Figure 10:
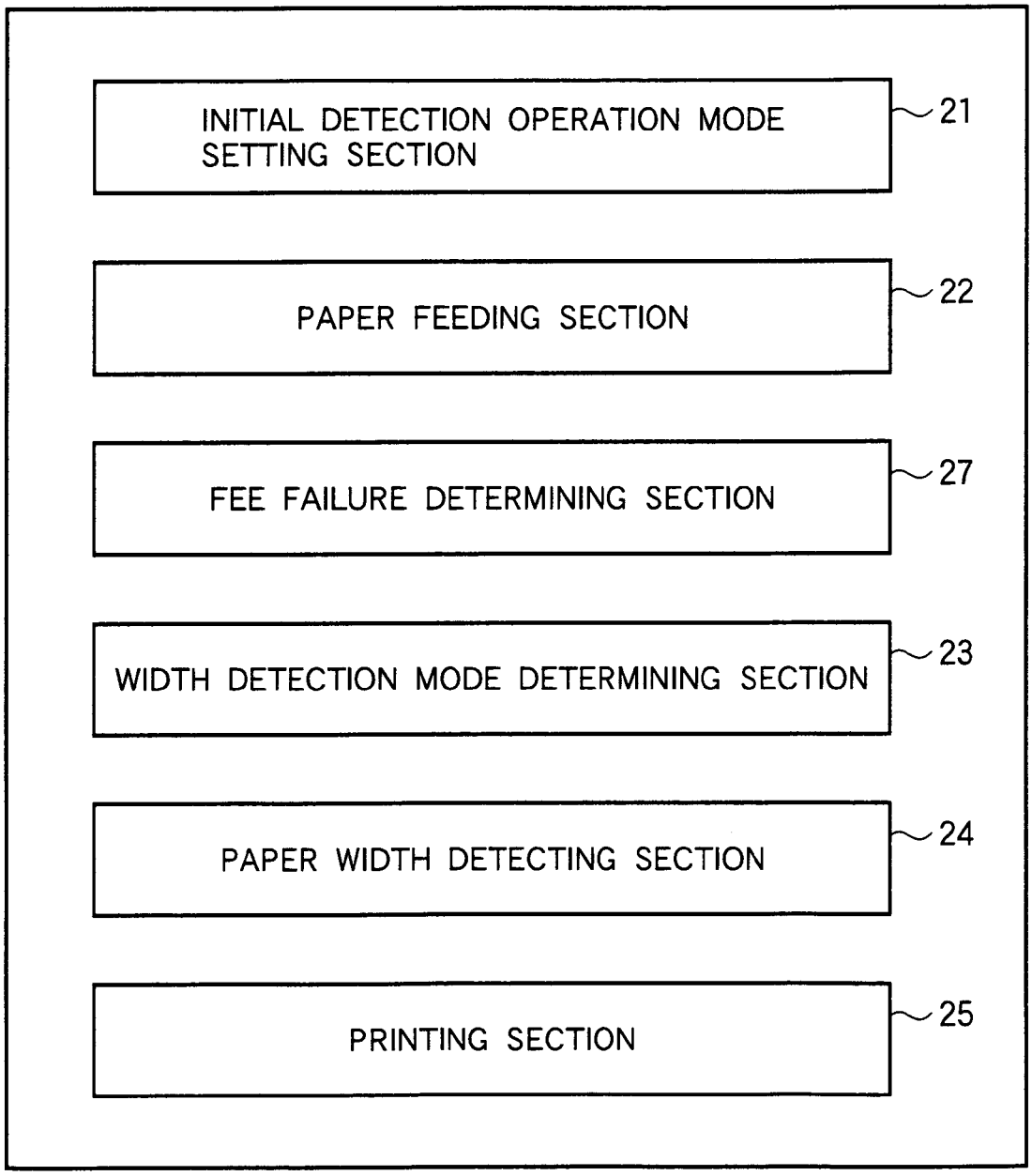
FIG. 10 is a block diagram illustrating a firmware of an image forming apparatus according to a third embodiment.

FIG. 10 is a block diagram illustrating a firmware of an image forming apparatus according to a third embodiment.

The third embodiment has a feature that when the paper feeding from a paper cassette fails, paper-width detection is performed for the first page of the print paper supplied after the failure of paper feeding.

The third embodiment differs from the first embodiment in that a feed-failure determining section 27 is added.

Figure 11:
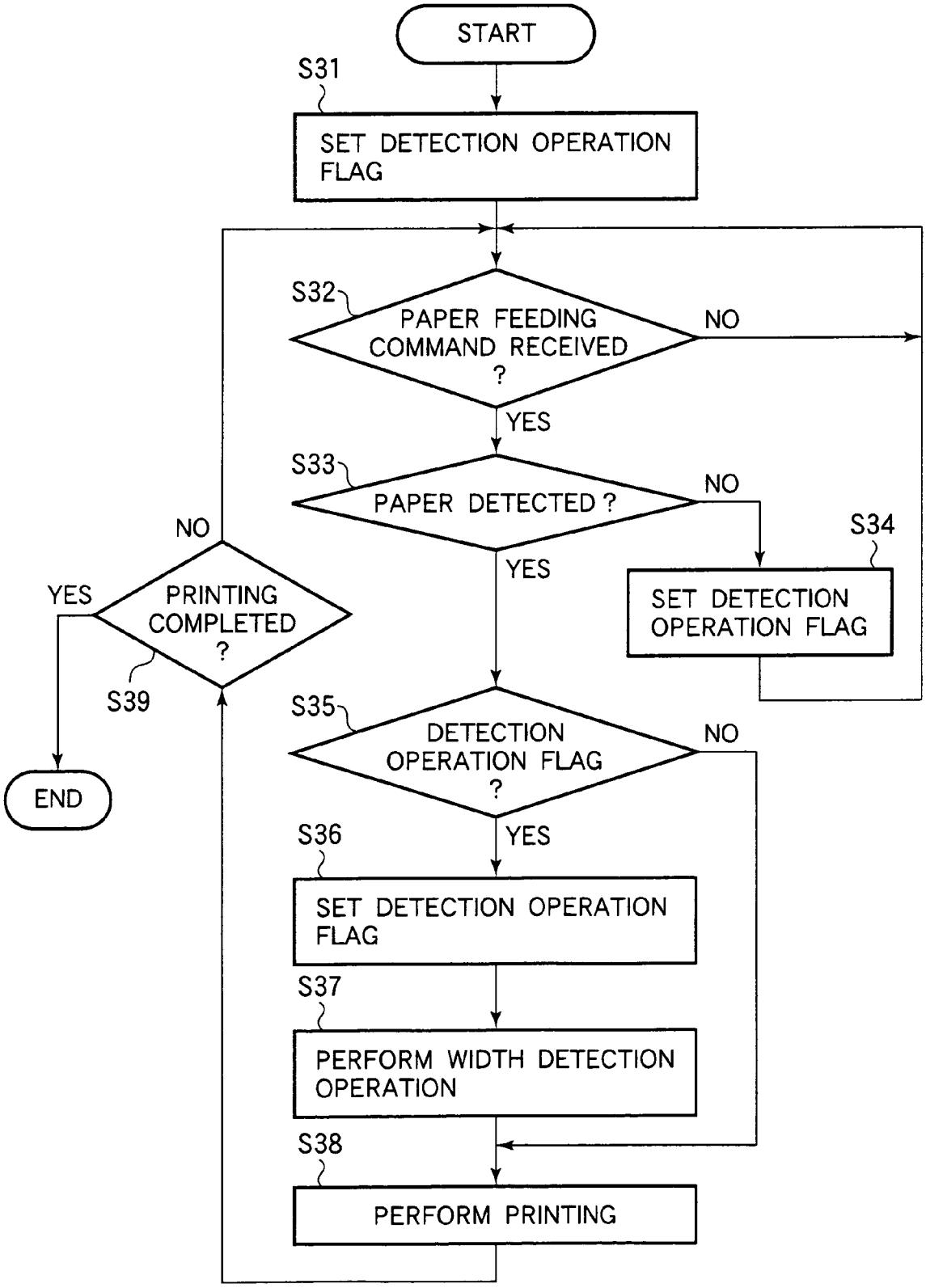
FIG. 11 is a flowchart illustrating the operation of paper-width detecting and printing operations.

FIG. 11 is a flowchart illustrating the operation of paper-width detection and printing.

When the image forming apparatus is turned on, the detection operation flag is first set (S31). Upon receiving a paper feeding command from a host apparatus (S32), the feed-failure determining section 27 checks a detection signal of the paper sensor 13*b* to determine whether the print paper is present in the paper cassette (S33). If the print paper is absent from the paper cassette (S33), then the detection operation flag is set (S34). After a stack of print paper is loaded into the paper cassette, the paper feeding operation is performed again upon receiving the paper feeding command from a host apparatus (S32).

When it is determined that the print paper is present in the paper cassette, a check is made to determine whether the detection operation flag has been set (S35). If the detection operation flag has been set, the detection operation flag is reset (S36) and the paper-width detection is performed (S37). Subsequently, the print data for one page received from the host apparatus is processed and printed and then the next page is fed. If the detection operation flag has not been set (S35), i.e., the detection operation flag has been reset, then printing is performed without performing the paper-width detection (S38).

As described above, when failure of paper feeding occurs, i.e., when the print paper is not present in the paper cassette or not normally fed from the paper cassette, the paper-width detection is performed for the first page of print paper supplied after the occurrence of failure of paper feeding.

The flowchart will be described.

Step S31: The detection operation flag is set.

Step S32: A check is made to determine whether a command for paper feeding has been received. If YES, the program proceeds to step S33. If NO, the program enters a standby state.

Step S33: A check is made to determine whether the print paper is present in the paper cassette. If YES, the program proceeds to step S35. If NO, the program proceeds to step S34.

Step S34: The detection operation flag is set.

Step S35: A check is made to determine whether the detection flag has been set. If YES, the program proceeds to step S36. If NO, the program proceeds to step S38.

Step S36: The paper detection operation is performed.

Step S38: Printing is performed.

Step S39: A check is made to determine whether printing has been completed. If YES, the program ends. If NO, the program loops back to Step S32.

The third embodiment addresses a case in which when the print paper in the paper cassette is exhausted, the user loads a stack of print paper into the paper cassette with the apparatus remaining turned on. The paper-width detection is performed for the first page of print paper fed after the interruption. This prevents the print data supplied after the interruption from being printed on the print paper of the wrong size. The paper-width detection is not performed for pages after the first page, thereby preventing the throughput of the image forming apparatus from decreasing.

The paper-width detection can be performed at an appropriate timing without providing an additional sensor for detecting the replenishment of the print paper into the paper cassette.

An apparatus according to the third embodiment may include the power-up-only mode described in the first embodiment. Alternatively, the main controller 11 may store into a memory the paper-width information on the final page of print paper that was used in the printing operation performed immediately before the apparatus is turned off. Then, when the apparatus is turned on again, the main controller 11 may read the information from the memory and set the paper width.

Fourth Embodiment

Elements similar to those in the first to third embodiments have been given the same references and the description is omitted.

Figure 12:
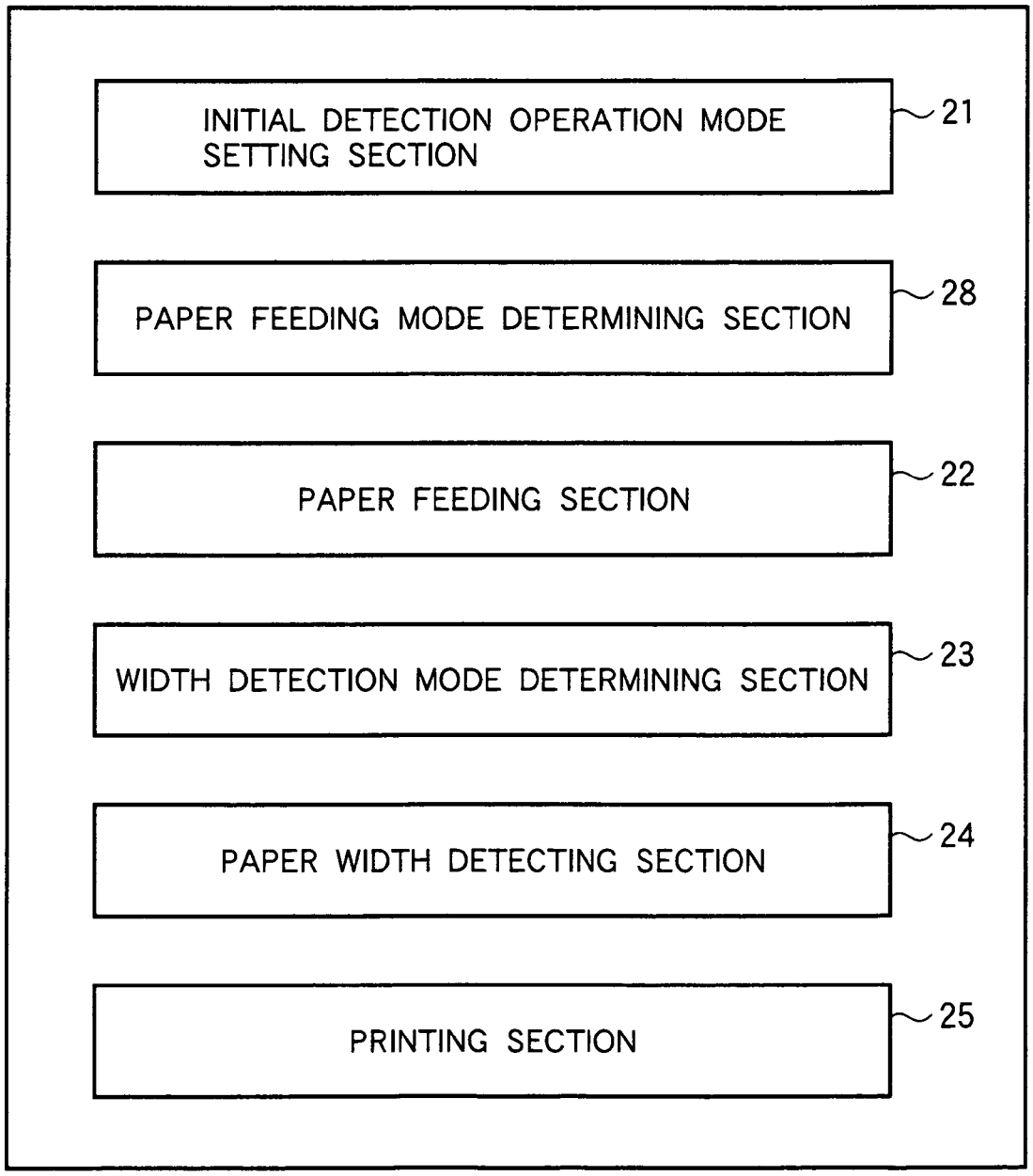
FIG. 12 is a block diagram of a firmware of an image forming apparatus according to a fourth embodiment.

FIG. 12 is a block diagram of a firmware of an image forming apparatus according to a fourth embodiment.

The fourth embodiment is featured in that when a paper feeding is switched from one paper feeding port to a paper cassette, the width of print paper is detected for the first page of print paper fed from the paper cassette.

The fourth embodiment differs from the first embodiment in that a paper-feeding mode determining section 28 is added. The paper feeding mode determining section 28 determines whether the paper feeding mode has been switched from, for example, a manual feeding mode or a continuous form mode to a paper cassette mode.

Figure 13:
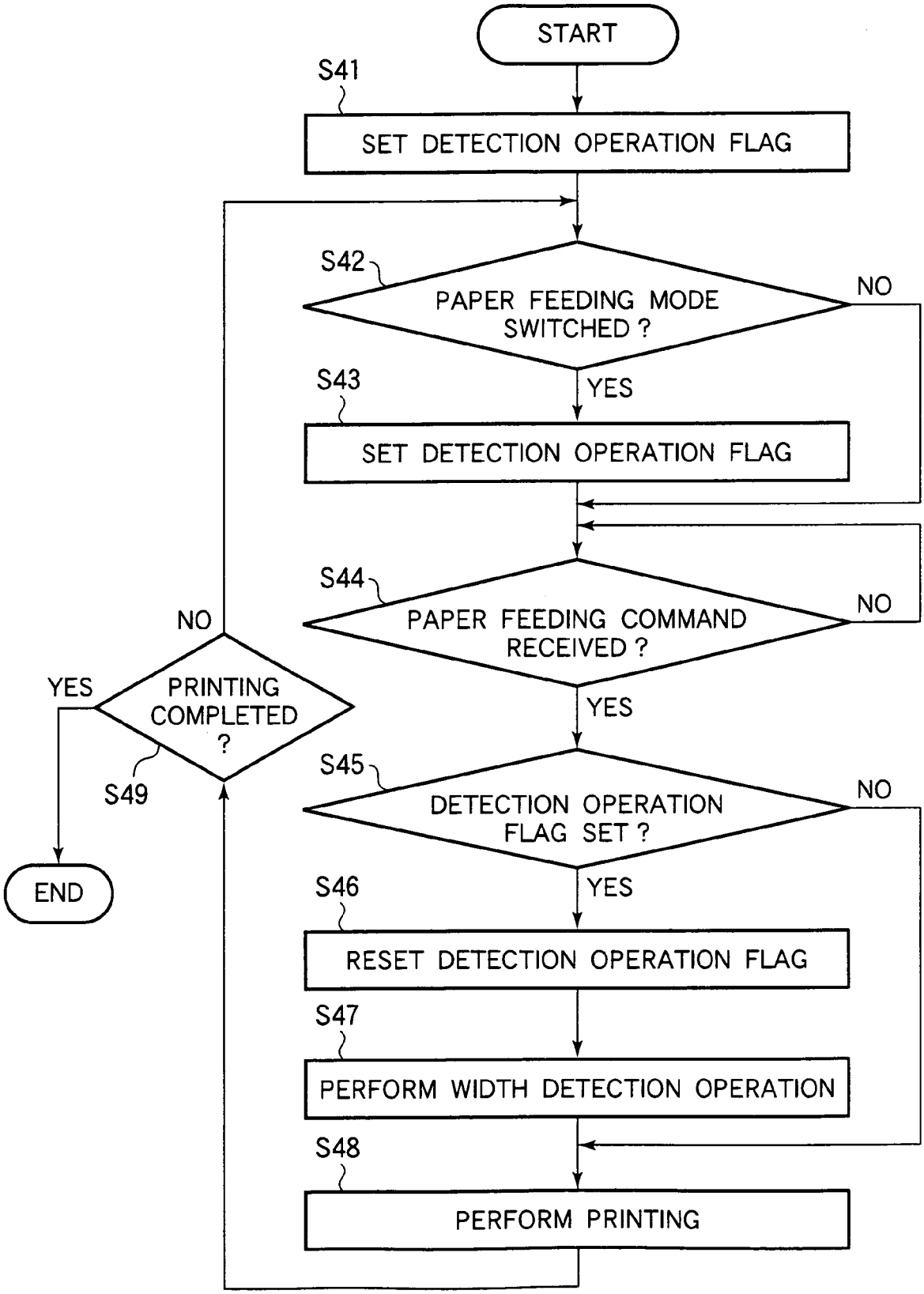
FIG. 13 is a flowchart illustrating the paper width detecting and printing operations.

FIG. 13 is a flowchart illustrating the paper width detecting and printing operations.

The paper-width detecting and printing operations will be described.

When the image forming apparatus is turned on, the detection operation flag is set as an initial set-up (S41). Then, the paper-feeding mode determining section 28 determines whether the paper feeding mode has been switched from, for example, the manual feeding mode or continuous form mode to the paper cassette mode (S42). If YES, then the detection operation flag is set (S43). If NO, print paper is fed in a mode different from the paper cassette mode (S44).

When the paper feeding command is received from the host apparatus, the paper feeding is initiated. Upon completion of paper feeding, a check is made to determine whether the detection operation flag has been set (S45). If the detection operation flag has been set, the detection operation flag is reset (S46) and the paper-width detection is performed (S47). Subsequently, the print data for one page of print paper received from the host apparatus is processed to print on the print paper, and then the next page of print paper is fed. If the detection operation flag has not been set, i.e., the detection operation flag has been reset (S45), the paper-width detection is not performed and printing is performed immediately (S48).

As described above, when printing is being performed on the print paper fed only from the same paper cassette, the paper detection operation is performed only once. Additionally, paper-width detection is performed for the first page of the print paper fed from the paper cassette after the paper feeding mode is switched from other paper feeding mode to the cassette feeding mode. The paper-width detection may also be performed when a different paper size is specified or when a direction in which printing is performed on the print paper is changed.

The flowchart will be described.

Step S41: The detection operation flag is set.

Step S42: A check is made to determine whether the paper feeding mode has been changed. If YES, the program proceeds to step s43. If NO, the program proceeds to Step S43.

Step S43: The detection operation flag is set.

Step S44: A check is made to determine whether a paper feeding command is received. If YES, the program proceeds to step S45. If NO, the program enters a standby state in which the program awaits the paper feeding command.

Step S45: A check is made to determine whether detection operation flag has been set. If YES, the program proceeds to step S46. If NO, the program proceeds to step S48.

Step S46: The detection operation flag is reset.

Step S47: The paper-width detection is performed.

Step S48: Printing is performed.

Step S49: A check is made to determine whether printing has been completed. If YES, the program ends. If NO, the program loops back to Step S42.

An apparatus according to the fourth embodiment may include the power-up-only mode described in the first embodiment. Alternatively, the main controller 11 may store into a memory the paper-width information on the final page of print paper that was used in the printing operation performed immediately before the apparatus is turned off. Then, when the apparatus is turned on again, the main controller 11 may read the information from the memory and set the paper width.

As described above, when the image forming apparatus remains turned on, if the paper feeding mode is switched from a mode to the paper cassette mode, the paper-width detection is performed to prevent printing on the paper of the wrong size. The paper-width detection is not performed for pages after the first page, thereby preventing the throughput of the image forming apparatus from decreasing.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image forming apparatus, comprising:

a medium-width detector that detects a width of a page of print medium; and a controller that controls said medium-width detector to detect the width of the page of print medium only after a printing operation has been activated and after a predetermined condition has been detected.

2. The image forming apparatus according to claim 1, wherein the predetermined condition is a power up of the image forming apparatus.

3. The image forming apparatus according to claim 1, wherein the predetermined condition is that print data has not been received for a predetermined time length after a last reception of the print data.

4. The image forming apparatus according to claim 1, wherein the predetermined condition is failure of transport of the print medium.

5. The image forming apparatus according to claim 4, wherein the failure of transport of the print medium is caused by absence of print medium.

6. The image forming apparatus according to claim 4, wherein the failure of transport of the print medium is caused by abnormal transport of print medium.

7. The image forming apparatus according to claim 1, wherein the predetermined condition is that a print job is received.

8. The image forming apparatus according to claim 1, further comprising:

a print head that moves in a direction of the width of the page of print medium; and a sensor mounted on said print head, wherein when said sensor detects the page of print medium, said sensor outputs a detection signal, wherein said medium-width detector causes said print head to move in the direction of the width of the page of print medium to detect the width of the page of print medium based on the detection signal.

9. The image forming apparatus according to claim 1, wherein said controller holds a plurality of conditions, and the predetermined condition is selected from among the plurality of conditions.

10. The image forming apparatus of claim 9, wherein one of the plurality of conditions is detected on a page-by-page basis.

11. An image forming apparatus comprising:

a medium-width detector that detects a width of a page of print medium; and a controller that controls said medium-width detector to detect the width of the page of print medium upon detection of a switching of a medium feeding mode.

12. The image forming apparatus according to claim 11, wherein when printing is performed on a following page of two consecutive pages of print medium, said controller controls said medium-width detector to detect the width of the following page if the following page has a size different from a preceding page of the two consecutive pages of print medium.

13. The image forming apparatus according to claim 11, wherein when printing is performed on a following page of two consecutive pages of print medium, said controller controls said medium width detector to detect the width of the following page if the printing is performed on the following page in a direction different from a preceding page of the two consecutive pages of print medium.

14. The image forming apparatus according to claim 11, wherein the page of print medium is fed from one of a plurality of medium-feeding positions located along a transport path of the page of print medium; and wherein the switching of the medium feeding mode is that a medium feeding position is switched from a first one of the plurality of medium-feeding positions to a second one of the plurality of medium-feeding positions.

15. The image forming apparatus according to claim 11, wherein the changing of the medium feeding mode is a switching of a size of print medium.

16. The image forming apparatus according to claim 11, wherein the changing of the medium feeding mode is a switching of a direction in which printing is performed on the medium.

17. An image forming apparatus, comprising:

a medium-width detector that detects a width of a page of print medium; and a controller that controls said medium-width detector to detect the width of the page of print medium when a printing operation has been activated for a first time after a changing of control of printing operation is detected.

18. An image forming apparatus, comprising:

a plurality of cassettes that hold print medium therein;

a medium-width detector that detects a width of a page of the print medium held in said plurality of cassettes;

a cassette selecting section, said cassette selecting section selecting a cassette that holds a print medium that should be printed on;

a cassette-selection detecting section that detects when said cassette selecting section switches from a first one of said plurality of cassettes to a second one of said plurality of cassettes; and a controller that controls said medium-width detector, wherein said controller controls said medium-width detector to detect the width of a first page of print medium supplied from the second one of said plurality of cassettes in accordance with a detection result of said cassette-selection detecting section.

* * * * *